US006351105B2

(12) United States Patent
Suzuki

(10) Patent No.: US 6,351,105 B2
(45) Date of Patent: Feb. 26, 2002

(54) POWER CONTROLLING UNIT AND THERMAL PROCESSING UNIT

(75) Inventor: Fujio Suzuki, Shiroyama-machi (JP)

(73) Assignee: Tokyo Electron Limited, Tokyo-To (JP)

( * ) Notice: Subject to any disclaimer, the term of this patent is extended or adjusted under 35 U.S.C. 154(b) by 0 days.

(21) Appl. No.: 09/817,266

(22) Filed: Mar. 27, 2001

(30) Foreign Application Priority Data

Mar. 27, 2000 (JP) ..... 12-086463

(51) Int. Cl.[7] ..... G05F 1/14
(52) U.S. Cl. ..... 323/255; 323/258
(58) Field of Search ..... 323/247, 255, 323/256, 257, 258, 268, 269, 282, 355, 358, 359

(56) References Cited

U.S. PATENT DOCUMENTS 4,769,751 A * 9/1988 Schraudolph et al. ..... 363/35
5,117,175 A * 5/1992 Pettigrew et al. ..... 323/256
5,166,597 A * 11/1992 Larsen et al. ..... 323/215

* cited by examiner

*Primary Examiner*—Matthew Nguyen
(74) *Attorney, Agent, or Firm*—Smith, Gambrell & Russell, LLP

(57) ABSTRACT

A power controlling unit of the invention includes a power transformer: having a primary side connected to an Alternating-Current power supply source; and a secondary side having an end side provided with a terminal connected to an end of an object whose power is to be controlled, and the other end side provided with a plurality of voltage taps. A switching part is disposed between the plurality of voltage taps and the other end of the object. The switching part selects one from the plurality of voltage taps in order to connect the one to the other end of the object. A storing part stores output values for the object and switching patterns which correspond to the output values respectively. Each of the output values is set correspondingly to a unit of control consisting of a plurality of cycles of the source. Each of the switching patterns defines a voltage tap that should be selected if any in each of the plurality of cycles in order to achieve the corresponding output value. A switching controlling part can read a switching pattern corresponding to an output value from the storing part and control the switching part based on the switching pattern.

26 Claims, 8 Drawing Sheets

| OUTPUT % | SWITCHING PATTERN | | | | | | | |
|---|---|---|---|---|---|---|---|---|
| | 1 CYCLE | 2CYCLE | 3CYCLE | 4CYCLE | 5CYCLE | 6CYCLE | 7CYCLE | 8CYCLE |
| 1 | 8%(42e) | 0 | 0 | 0 | 0 | 0 | 0 | 0 |
| 2 | 8 | 0 | 0 | 0 | 0 | 0 | 0 | 0 |
| 3 | 8 | 8 | 0 | 0 | 0 | 0 | 0 | 0 |
| 4 | 8 | 8 | 8 | 8 | 0 | 0 | 0 | 0 |
| 5 | 8 | 8 | 8 | 8 | 8 | 0 | 0 | 0 |
| 6 | 8 | 8 | 8 | 8 | 8 | 8 | 0 | 0 |
| 7 | 8 | 8 | 8 | 8 | 8 | 8 | 8 | 0 |
| 8 | 8 | 8 | 8 | 8 | 8 | 8 | 8 | 8 |
| 9 | 16%(42d) | 8 | 8 | 8 | 8 | 8 | 8 | 8 |
| 10 | 16 | 16 | 8 | 8 | 8 | 8 | 8 | 8 |
| 11 | 16 | 16 | 16 | 8 | 8 | 8 | 8 | 8 |
| 12 | 16 | 16 | 16 | 16 | 8 | 8 | 8 | 8 |
| 13 | 16 | 16 | 16 | 16 | 16 | 8 | 8 | 8 |
| 14 | 16 | 16 | 16 | 16 | 16 | 16 | 8 | 8 |
| 15 | 16 | 16 | 16 | 16 | 16 | 16 | 16 | 8 |
| 16 | 16 | 16 | 16 | 16 | 16 | 16 | 16 | 16 |
| 17 | 32%(42c) | 16 | 16 | 16 | 16 | 16 | 8 | 16 |
| 18 | 32 | 16 | 16 | 16 | 16 | 16 | 16 | 16 |
| 19 | 32 | 32 | 16 | 16 | 16 | 16 | 8 | 16 |
| 20 | 32 | 32 | 16 | 16 | 16 | 16 | 16 | 16 |
| ⋮ | | | | | | | | |
| 97 | 128%(42a) | 128 | 128 | 128 | 128 | 64%(42b) | 8 | 64 |
| 98 | 128 | 128 | 128 | 128 | 128 | 128 | 8 | 8 |
| 99 | 128 | 128 | 128 | 128 | 128 | 128 | 16 | 8 |
| 100 | 128 | 128 | 128 | 128 | 128 | 64 | 32 | 64 |

FIG. 4

| OUTPUT (%) | 1 | 2 | 3 | 4 | 5 | 6 | 7 | 8 |
|---|---|---|---|---|---|---|---|---|
| 1 | 8 | 0 | 0 | 0 | 0 | 0 | 0 | 0 |
| 2 | 8 | 8 | 0 | 0 | 0 | 0 | 0 | 0 |
| ⋮ | | | | | | | | |
| 20 | 32 | 32 | 16 | 16 | 16 | 16 | 16 | 16 |
| ⋮ | | | | | | | | |
| 100 | 128 | 128 | 128 | 128 | 128 | 64 | 32 | 64 |

POWER CONTROLLING UNIT AND THERMAL PROCESSING UNIT

BACKGROUND OF THE INVENTION

1. Field of the Invention

This invention relates to a power controlling unit that can control a power supplied to a heater or the like, a power controlling method by using the power controlling unit, and a thermal processing unit incorporating the power controlling unit.

2. Disclosure of the Prior Art

As a manufacturing unit for semiconductor devices, there is known a vertical thermal processing unit that can conduct a thermal process in a batch manner.

Fig.9 schematically shows such a conventional vertical thermal processing unit and a power controlling unit used with the conventional vertical thermal processing unit. The conventional thermal processing unit comprises a tubular reaction tube 11, which is made of for example crystal. A wafer boat (not shown) supporting many semiconductor wafers is loaded into the reaction tube 11 through an under portion of the reacting tube 11. A heater 12 consisting of three zone-heaters 12*a*, 12*b* and 12*c* surrounds a lateral (peripheral) surface of the reaction tube 11. The reaction tube 11 and the heater 12 form a heating furnace 13. Heat values generated by the respective zone-heaters 12*a*, 12*b* and 12*c* are adjusted by the power controlling unit that is connected to the respective zone-heaters 12*a*, 12*b* and 12*c*.

Thus, a suitable thermal process can be conducted to the wafers loaded into the reaction tube 11.

The power controlling unit comprises a power transformer 15 of a fixed voltage and a power supply source 14 arranged at a primary side of the power transformer 15. Power is adapted to be delivered from the power supply source 14 to the respective zone-heaters 12*a*, 12*b* and 12*c* via the power transformer 15. That is, volume of the power supplied to the respective zone-heaters is controlled by controlling timings to turn on or off respective semiconductor switches in a switch unit 16 arranged at a secondary side of the power transformer 15. In addition, protective units from overcurrent (for example fuses) 17*a*, 17*b* and 17*c* are disposed between the power transformer 15 and the switch unit 16.

There are known a method of employing a phase control SCR (silicon controlled rectifier) for the semiconductor switches in the switching unit 16 and a method of employing a zero-cross control SCR for the semiconductor switches in the switching unit 16. For example, the former method may be used in a case wherein the heating furnace 13 is formed into a rapid-heating furnace having a great rising rate of temperature, for example about 100° C./minute. The latter method may be used in a case wherein the heating furnace 13 is a general furnace.

In the phase control SCR, the switch for the power supply can be turned ON or OFF at any timing in one cycle of 360 degrees. Thus, higher resolution can be achieved. On the other hand, in the zero-cross control SCR, the switch for the power supply can be turned ON or OFF only at a timing when the voltage is zero bolt in one cycle. For example, if a frequency of the power supply source is 50 Hz, volume of the supplied power can be changed only according to 50 ranks per 1 second, by turning ON or OFF the switch every cycle of the power supply source. For example, if the switch is turned ON at the first cycle, turned OFF at the second cycle, and remains OFF at the other cycles, the volume of the supplied power is 2% of a maximum volume thereof (100%×1/50). If the number of cycles when the switch is turned ON or remains ON is increased, the volume of the supplied power is also increased by 2% (2, 4, 6, . . . , 100%).

In general, a heater used in the rapid-heating furnace has a great changing rate of resistance against temperature. Thus, in order to control temperature of the heater stably, it is preferable that the phase control SCR that can achieve higher resolution is used. However, there is a problem that phase control SCR may output higher harmonic waves of not negligible levels. Thus, in a conventional unit using the phase control SCR, large-scale active filters are used to remove the higher harmonic waves. Such a unit for removing the higher harmonic waves is expensive, that is, there is also a problem about cost.

On the other hand, if the zero-cross control SCR is used, levels of generated higher harmonic waves are less than those in the case wherein the phase control SCR is used. However, because the switch for the power supply may be turned ON or OFF only one time per 1 cycle in order to adjust the volume of the supplied power, resolution of the supplied power depends on the frequency (cycle) of the power supply source. That is, it is difficult to control the supplied power finely. Thus, it is difficult to use the zero-cross control SCR for the rapid-heating furnace.

SUMMARY OF THE INVENTION

This invention is intended to solve the above problems effectively. An object of this invention is to provide a power controlling unit and a method thereof that can prevent higher harmonic waves from being generated and that can achieve higher resolution. Another object of this invention is to provide a thermal processing unit that can control temperature thereof stably by using the above power controlling unit.

This invention is a power controlling unit comprising: a power transformer having a primary side that can be connected to an Alternating-current power supply source, and a secondary side having an end side provided with a terminal that can be connected to an end of an object whose power is to be controlled, and the other end side provided with a plurality of voltage taps; a switching part disposed between the plurality of voltage taps and the other end of the object, the switching part selecting one from the plurality of voltage taps in order to connect the one to the other end of the object; a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value; and a switching controlling part that can read a switching pattern corresponding to an output value from the storing part and that can control the switching part based on the switching pattern.

Alternatively, this invention is a power controlling unit comprising: a power transformer having a secondary side that can be connected to an object whose power is to be controlled, and a primary side having an end side provided with a terminal that can be connected to an end of an Alternating-Current power supply source, and the other end side provided with a plurality of voltage taps; switching part disposed between the plurality of voltage taps and the other end of the Alternating-Current power supply source, the switching part selecting one from the plurality of voltage taps in order to connect the one to the other end of the Alternating-Current power supply source; a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value; and a switching controlling part that can read a switching pattern corresponding to an output value from the storing part and that can control the switching part based on the switching pattern.

According to the above inventions, higher resolution can be achieved so that supplied power can be controlled more finely. For example, if the object whose power is to be controlled is a heater consisting of a resistance heating element, temperature of the heater can be controlled stably, even if the heater has a great changing rate of resistance against temperature.

Preferably, respective load powers that are generated when the respective voltage taps of the power transformer are selected in turn are set to reduce by half from a maximum thereof to a minimum thereof in turn. In the case, binary numbers of logic circuit can be used for processes effectively.

The respective voltage taps of the power transformer may be set correspondingly to a desired controlling manner for the object whose power is to be controlled. For example, respective load currents that are generated when the respective voltage taps of the power transformer are selected in turn are set to reduce by half from a maximum thereof to a minimum thereof in turn. Alternatively, respective load voltages that are generated when the respective voltage taps of the power transformer are selected in turn are set to reduce by half from a maximum thereof to a minimum thereof in turn.

In addition, preferably, the switching controlling part can control the switching part to switch the voltage taps when a voltage waveform at the secondary side of the power transformer crosses zero volt. Furthermore, preferably, the order of the voltage taps that are connected (turned ON) is set in such a manner that voltage difference between two voltage taps of any adjacent two cycles is as small as possible. In the case, higher harmonic waves, which may be generated because of a great voltage difference, can be more effectively prevented from being generated.

In addition, this invention is a method of controlling a power supplied to an object whose power is to be controlled, by using a power controlling unit including: a power transformer having a primary side that can be connected to an Alternating-Current power supply source and a secondary side having an end side provided with a terminal that can be connected to an end of the object, and the other end side provided with a plurality of voltage taps; a switching part disposed between the plurality of voltage taps and the other end of the object, the switching part selecting one from the plurality of voltage taps in order to connect the one to the other end of the object; a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value; and a switching controlling part that can read a switching pattern corresponding to an output value from the storing part and that can control the switching part based on the switching pattern; the method comprising: a setting step of generating an output value to the object correspondingly to the unit of control consisting of the plurality of cycles of the frequency of the Alternating-Current power supply source; a reading step of reading a corresponding switching pattern from the storing part based on the generated output value; and a switching step of changing the voltage taps to be connected to the other end of the object, based on the read switching pattern.

Preferably, the switching step is conducted when a voltage waveform at the secondary side of the power transformer crosses zero volt.

Alternatively, this invention is a method of controlling a power supplied to an object whose power is to be controlled, by using a power controlling unit including: a power transformer having a secondary side that can be connected to the object, and a primary side having an end side provided with a terminal that can be connected to an end of an Alternating-Current power supply source, and the other end side provided with a plurality of voltage taps; a switching part disposed between the plurality of voltage taps and the other end of the Alternating-Current power supply source, the switching part selecting one from the plurality of voltage taps in order to connect the one to the other end of the Alternating-Current power supply source; a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value; and a switching controlling part that can read a switching pattern corresponding to an output value from the storing part and that can control the switching part based on the switching pattern; the method comprising: a setting step of generating an output value to the object correspondingly to the unit of control consisting of the plurality of cycles of the frequency of the Alternating-Current power supply source; a reading step of reading a corresponding switching pattern from the storing part based on the generated output value; and a switching step of changing the voltage taps to be connected to the other end of the object, based on the read switching pattern.

In the case too, preferably, the switching step is conducted when a voltage waveform at the secondary side of the power transformer crosses zero volt.

Alternatively, this invention is a thermal processing unit comprising; a reacting container that can conduct a thermal process to an object to be processed; a heater arranged surrounding the reacting container; a power transformer having a primary side that can be connected to an Alternating-Current power supply source, and a secondary side having an end side provided with a terminal connected to an end of the heater, and the other end side provided with a plurality of voltage taps; a switching part disposed between the plurality of voltage taps and the other end of the heater, the switching part selecting one from the plurality of voltage taps in order to connect the one to the other end of the heater; a storing part that stores a plurality of output values for the heater and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value; and a switching controlling part that can read a switching pattern corresponding to an output value from the storing part and that can control the switching part based on the switching pattern.

Alternatively, this invention is a thermal processing unit comprising; a reacting container that can conduct a thermal process to an object to be processed; a heater arranged surrounding the reacting container; a power transformer having a secondary side connected to the heater, and a primary side having an end side provided with a terminal that can be connected to an end of an Alternating-Current power supply source, and the other end side provided with a plurality of voltage taps; a switching part disposed between the plurality of voltage taps and the other end of the Alternating-Current power supply source, the switching part selecting one from the plurality of voltage taps in order to connect the one to the other end of the Alternating-Current power supply source; a storing part that stores a plurality of output values for the heater and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value; and a switching controlling part that can read a switching pattern corresponding to an output value from the storing part and that can control the switching part based on the switching pattern.

In these cases, preferably, respective load powers that are generated when the respective voltage taps of the power transformer are selected in turn are set to reduce by half from a maximum thereof to a minimum thereof in turn. Alternatively, respective load currents that are generated when the respective voltage taps of the power transformer are selected in turn are set to reduce by half from a maximum thereof to a minimum thereof in turn. Alternatively, respective load voltages that are generated when the respective voltage taps of the power transformer are selected in turn are set to reduce by half from a maximum thereof to a minimum thereof in turn.

In addition, preferably, the switching controlling part can control the switching part to switch the voltage taps when a voltage waveform at the secondary side of the power transformer crosses zero volt.

BRIEF DESCRIPTION OF THE DRAWINGS

FIG. 4 is a view of an example of switching pattern;

DESCRIPTION OF THE PREFERRED EMBODIMENT

Figure 1:
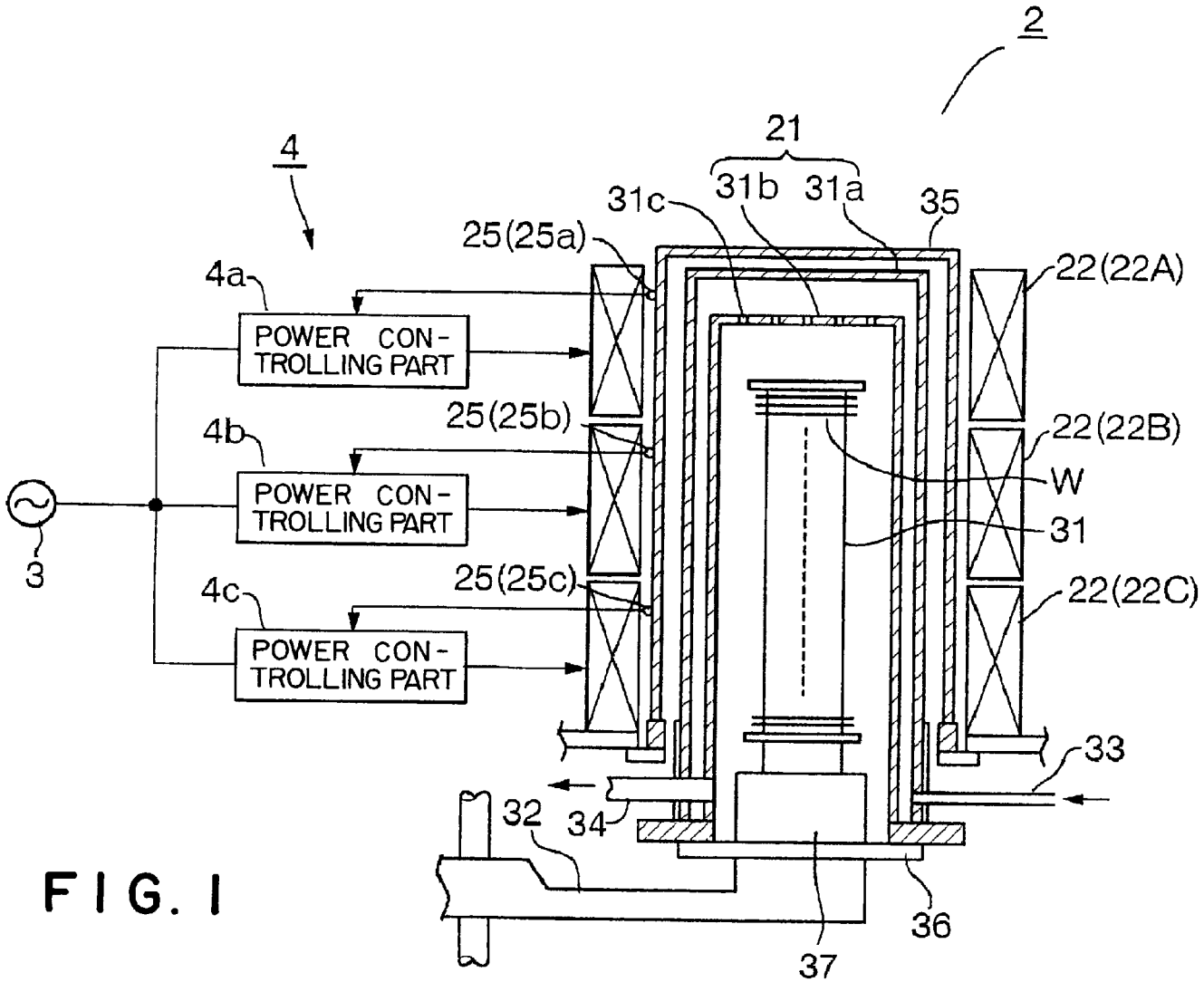
FIG. 1 is a schematic view of an embodiment of a power controlling unit according to the invention, for a heater of a vertical thermal processing unit as an object whose power is to be controlled.

FIG. 1 schematically shows an embodiment of a power controlling unit according to the invention. The power controlling unit is arranged for controlling a heater of a vertical thermal processing unit, which is a semiconductor manufacturing unit, as an object whose power is to be controlled.

The vertical thermal processing unit comprises a heating furnace 2, a wafer boat 31 as a holder, and a boat elevator 32 that can cause the wafer boat 31 to vertically move.

The heating furnace 2 comprises: a double-type of reaction tube 21 consisting of an outside tube 31*a* and an inside tube 31*b*, and a heater 22 consisting of a resistance heating element that is arranged surrounding a lateral surface of the reaction tube 21. The outside tube 31*a* and the inside tube 31*b* are made of for example crystal. A gas-supplying tube 33 is communicated with a space between the outside tube 31a and the inside tube 31*b* at a base portion of the reaction tube 21. A gas-exhausting tube 34 is communicated with a space in the inside tube 31*b* at the base portion of the reaction tube 21. Thus, a gas is adapted to flow from the space between the outside tube 31*a* and the inside tube 31*b* into the space in the inside tube 31*b* via a plurality of gas-holes 31*c* provided at a ceiling portion of the inside tube 31*b*. A numeral reference 35 indicates a container for equally heating. The wafer boat 31 is adapted to hold many semiconductor wafers in a tier-like manner. An opening at a lower end of the heating furnace 2 is opened and closed by a lid 36 that is fixed to the boat elevator 32. The wafer boat 31 is disposed on the lid 36 via a thermal insulation cylinder 37. Thus, when the boat elevator 32 moves vertically, the wafer boat 31 is loaded into or unloaded out of the heating furnace 2.

The heater 22 is divided into a plurality of (for example three of upper, middle and lower) zone-heaters 22*a*, 22*b* and 22*c*. Power from an Alternating-Current power supply source 3 is adapted to be supplied to the respective zone-heaters 22*a*, 22*b* and 22*c* via power controlling parts 4 (4*a*, 4*b* and 4*c*). In addition, thermometers 25 (25*a*, 25*b* and 25*c*) such as thermocouples are disposed at outside portions of the reaction tube 21 facing to the respective zone-heaters 22*a*, 22*b* and 22*c*. The respective power controlling parts 4*a*, 4*b* and 4*c* are adapted to conduct feedback controls based on temperatures detected by the thermometers 25 (25*a*, 25*b* and 25*c*).

Figure 2:
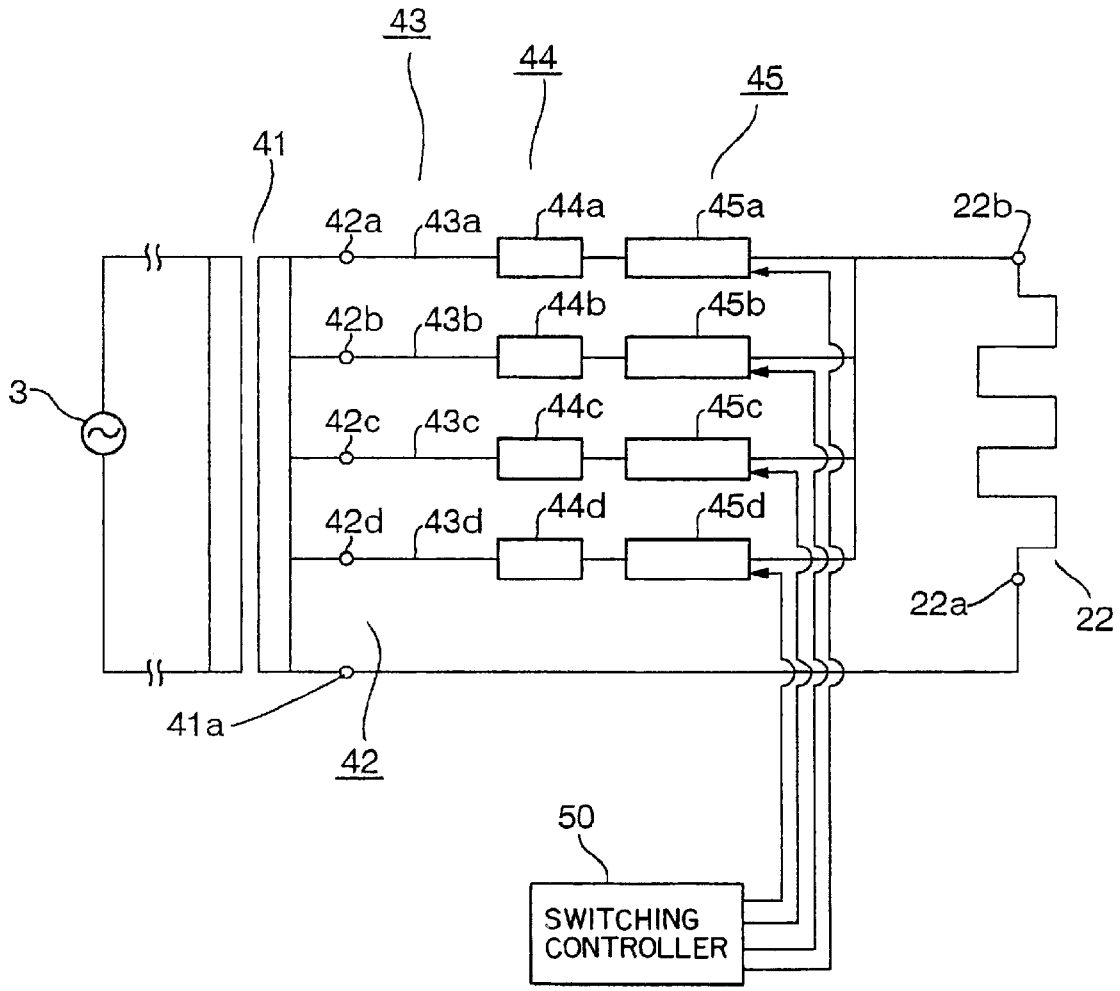
FIG. 2 is a schematic view of the power controlling part shown in FIG. 1.

Then, the power controlling parts 4 (4*a*, 4*b* and 4*c*) that are a main part of the embodiment are explained. In FIG. 2, the power controlling parts 4 include all of elements except the heater 22 and the Alternating-Current power supply source 3. Herein, the three power controlling parts 4*a*, 4*b* and 4*c* have the same structure, so that only one power controlling part 4 is explained.

In FIG. 2, the power transformer 41 has a secondary side provided with a plurality of voltage taps and a primary side connected to the Alternating-Current power supply source 3. In detail, the secondary side of the power transformer 41 has an end side provided with a terminal 41*a* connected to an end (a terminal 22*a*) of the heater 22 and the other end side provided with four voltage taps 42 (42*a*, 42*b*, 42*c* and 42*d*). The voltage taps 42*a*–42*d* are connected to the other end (a terminal 22*b*) of the heater 22 via respective wires 43 (43*a*, 43*b*, 43*c* and 43*d*). On the ways of the respective wires 43*a*–43*d*, there are respective fuses 44 (44*a*, 44*b*, 44*c* and 44*d*) for protecting the heater 22 from overcurrent and a switching part 45 (including switches 45*a*, 45*b*, 45*c* and 45*d* such as thyristors(SCR)) for selecting one from the voltage taps in order to connect the one to the other end of the heater 22. In addition, the switches 45*a*–45*d* are connected to a switching controller 50 that controls to turn ON or OFF the respective switches.

Each of the voltage taps 42*a*–42*d* is adapted to output a voltage corresponding to a rate of the number of windings at each of the voltage taps of the secondary side of the power transformer 41 with respect to the number of windings of the primary side of the power transformer 41. In a constant-power control, the respective voltages outputted from the respective voltage taps 42*a*–42*d* are set in such a manner that respective load powers reduce by half in order of 100%, 50%, 25% and 12.5%. Thus, the constant-power control may be easily achieved by using binary numbers. Similarly, in a constant-current control, the respective voltages are set in such a manner that respective load currents reduce by half in order of 100%, 50%, 25% and 12.5%. Alternatively, in a constant-voltage control, the respective voltages are set in such a manner that respective load voltages reduce by half in order of 100%, 50%, 25% and 12.5%.

The constant-power control is explained in more detail. If 100 volts correspond to 100%, three voltage taps (42*b*:n=1, 42*c*:n=2 and 42*d*:n=3) may be set in the power transformer 41 in such a manner that respective voltages Vn outputted from the three voltage taps satisfy the following expression (1).

$$Vn=(Vmax/(2^n)^{1/2})+Vd \quad (1)$$

In the expression (1), Vmax represents a voltage of 100%, Vd represents a voltage drop caused by the fuse 44, the switch 45 and the wire 43.

In the expression (1), if Vd is negligible, the voltages outputted from the respective voltage taps in FIG. 2 are 70.7 volts for 50% (n=1), 50 volts for 25% (n=2) and 35.4 volts for 12.5% (n=3). Actually, it is preferable that each Vn is determined considering the above Vd. Especially, if there may be a voltage drop by a larger current or the like, the voltages may be preferably raised by the voltage drop.

The switches 45*a*–45*d* are turned ON or OFF in order to control electrical connections of the respective wires 43*a*–43*d* extended from the voltage taps 42*a*–42*d*. Similarly to the zero-cross control, the switches 45*a*–45*d* are turned ON or OFF when a voltage waveform at the secondary side of the power transformer 41 crosses zero bolt (zero-cross). Thus, in the embodiment, for 1 cycle, resolution of the power control is only 4 ranks of 100%, 50%, 25% and 12.5%. However, in the embodiment, a unit of control is not 1 cycle but a plurality of cycles. In the unit of control, the switches 45*a*–45*d* are turned ON or OFF variously. Thus, the resolution of the power control can be increased.

In the embodiment, a pattern table is stored in the switching controller 50 in advance. The pattern table defines a correspondence of a plurality of output values and a plurality of switching patterns defining a voltage tap that should be selected if any in each of the plurality of cycles as the unit of control. Thus, the voltage tap that should be selected in each of the plurality of cycles in order to achieve the corresponding output value can be read from the switching controller 50. Then, the switch 45 corresponding to the read voltage tap is turned ON. According to the above steps, the power control can be conducted based on combinations of the voltage taps selected in each of the plurality of cycles as the unit of control. Thus, higher resolution can be achieved.

Next, a power controlling part of another embodiment, which is more suitable for an actual unit, is explained with reference to FIG. 3. In the embodiment, a constant-power control is conducted. In the case, for convenience, the other end side of the secondary side of the power transformer 41 is provided with five voltage taps 42*a*–42*e*. In addition, similarly to the power controlling part 4 shown in FIG. 2, there are respective fuses 44 (44*a*–44*e*) and a switching part 45 (including switches 45*a*–45*e*), on the ways of respective wires 43 (43*a*–43*e*) extended from the voltage taps 42. Voltages outputted from the respective voltage taps 42*a*–42*e* in the embodiment shown in FIG. 3 are 113.1 volts for 128%, 80 volts for 64%, 56.6 volts for 32%, 40 volts for 16% and 28.3 volts for 8%, in order of height.

Figure 3:
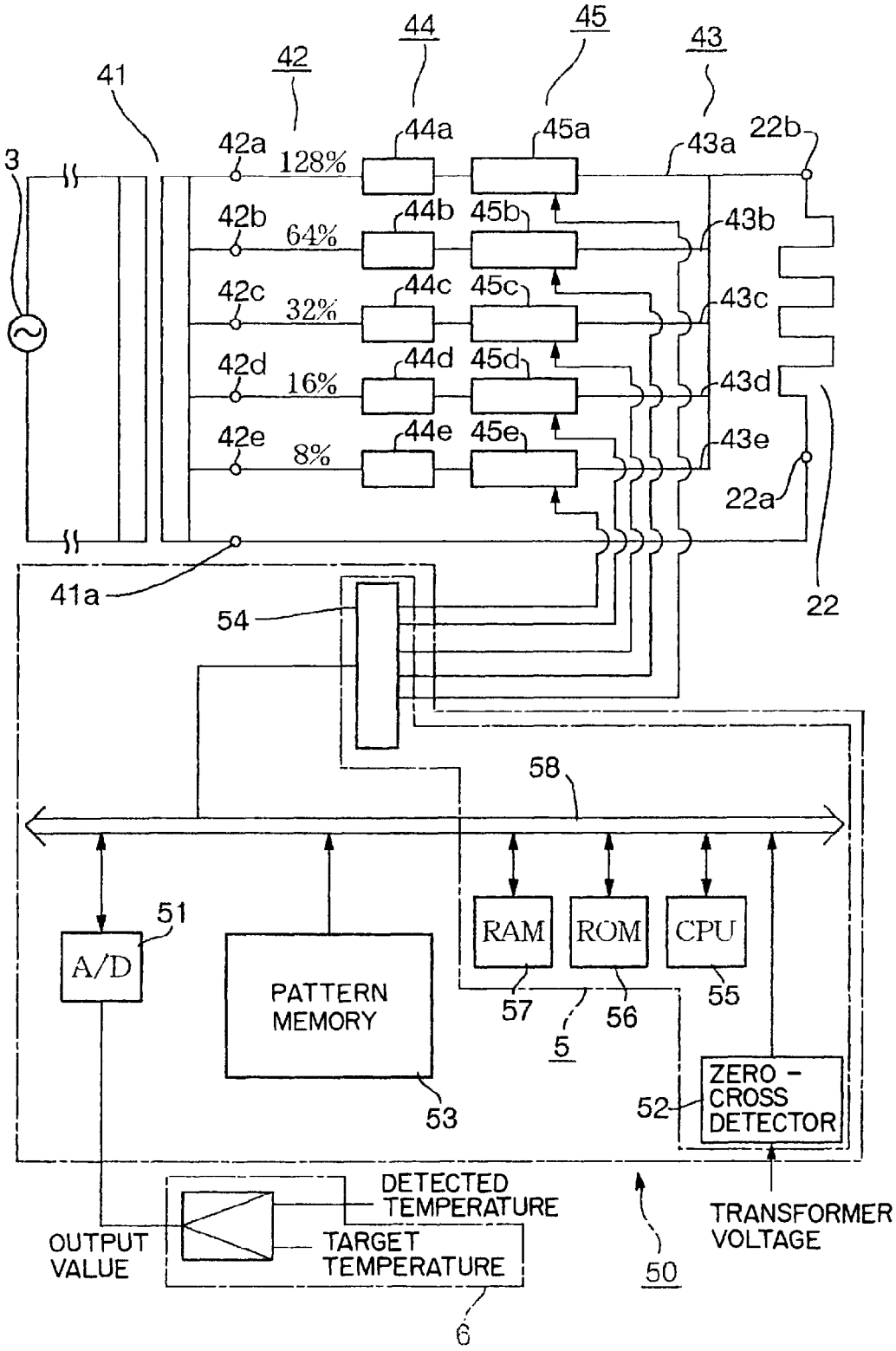
FIG. 3 is a schematic view for explaining a modified example of the power controlling part shown in FIG. 2.

In FIG. 3, the thermometers 25 explained with reference to FIG. 1 are not shown. However, in the case too, detecting signals from the thermometers are adapted to be transmitted to a temperature controller 6 (see FIG. 3) in the power controlling part 4 (see FIG. 1). In the temperature controller 6, the detecting signals and target temperatures are compared with each other, so that a result of the comparison is outputted as an output value. For example, the output value is a current in a range of 4–20 mA correspondingly to 0–100% of the power.

The switching controller 50 has: an A/D converter 51 that can convert the output value being an analogue signal from the temperature controller 6 into a digital signal; a zero-cross detector 52 that can obtain timing standard signals to turn ON or OFF the switches 45; a pattern memory 53 as a storing part that can store the pattern table for turning ON or OFF the switches 45*a*–45*e* correspondingly to the output value; a gate driver 54 that can output gate signals for the switches 45*a*–45*e* generated based on the pattern table; a CPU 55 being a data processor; a ROM 56 storing programs for the power control; and a RAM 57 being a memory for operations. The above components are connected to each other via a bus 58. In the embodiment, the zero-cross detector 52, the gate driver 54, the CPU 55, the ROM 56 and the RAM 57 form a switching controller 5.

An example of pattern table stored in the pattern memory 53 is explained with reference to FIG. 4. In the embodiment, the switching patterns for the switches 45 are set every unit of control consisting of several cycles that may not cause any problem in using an object whose power is to be controlled. Herein, the unit of control consists of 8 cycles.

In the pattern table shown in FIG. 4, the switching patterns including 8 cycles are assigned to every output % in a range of 1–100% by 1%. The output % corresponds to an index (an address) which the CPU 55 uses for selecting one switching pattern for example based on the output value outputted from the temperature controller 6. The switches 45 may be turned or remain ON or OFF from the first cycle to the eighth cycle in turn.

The relationship between the output % and the switching pattern is explained in more detail. In the embodiment, 7-bit signals are used for each of the switching patterns, that is, $2^7$=128 switching patterns may be prepared. In each of the switching patterns, one switch 45 that should be turned or remain ON is defined for every cycle if any. In the pattern table shown in FIG. 4, each output % of the voltage tap 52 that should be turned or remain ON is shown for every cycle of the unit of control. However, actually, each identification code corresponding to each switch 45 for the voltage tap of each output % is stored for every cycle of the unit of control.

In more detail, in the example shown in FIG. 3, when the voltage tap 42*a* is selected, the maximum power can be obtained. If a value of the maximum power is assigned to 128%, the power when the voltage tap 42*b* is selected is half as much as the power when the voltage tap 42*a* is selected, that is, substantially 64%. Similarly, the powers when the voltage taps 42*c*, 42*d* and 42*e* are selected are 32%, 16% and 8%, respectively.

In addition, values of output % are shown in a vertical file in FIG. 4, wherein the maximum power for the 8 cycles as the unit of control is set as 100%. The maximum power for the 8 cycles can be obtained when the voltage tap 42*a* is selected for all the 8 cycles. The value is (8 cycles)=(128% that is the output % assigned to the voltage tap 42*a*)=1024%. This means that the maximum power for the 8 cycles is assigned to 1024%. Thus, output 1% for the 8 cycles is obtained when the voltage tap 42*e* of 8% in 1 cycle is selected for only one cycle and no voltage tap is selected for the other cycles. Similarly, output 2% for the 8 cycles is obtained when the voltage tap 42*e* of 8% is selected for only two cycles and no voltage tap is selected for the other cycles. Thus, the switching patterns may be set in order of lowness, for example, the first switching pattern may be set such that the switch 45*e* (output 8%) is ON for the first cycle and all the switches are OFF for the other cycles, the second switching pattern may be set such that the switch 45*e* (output 8%) is ON for the first and second cycles and all the switches are OFF for the other cycles, and so on.

The above patterns are assigned to the 7-bit signals. Although the 7-bit signals can form 1–128% patterns by 1% (1–1024% patterns by 8%), only 1–100% (1–800% by 8%) of the patterns are used for the switching patterns.

According to the above steps, every switching pattern, it is determined how many cycles the respective switches 45 are tuned or remain ON for. Herein, in one switching pattern, the respective switches 45 that should be turned or remain ON can be freely assigned to the respective cycles in any order. However, the order of the switches 45 is preferably set in such a manner that voltage difference between two voltage taps 42 selected for any adjacent two cycles is as small as possible. For example, in a switching pattern for output 97 %, the order of the switches 45 for the 8 cycles is more preferably 128%, 128%, 128%, 64% and 8% than 128%, 128%, 8%, 128%, 64% and 128%. In the case, a great voltage change may be prevented, so that higher-order current of higher harmonic waves can be prevented from being generated. Herein, regarding the switching patterns smaller than output 7%, only the switch 45*e* (output 8%) can be selected. In the switching patterns, the operation is substantially similar to the zero-cross control SCR. In these cases, the current is so small that current of higher harmonic waves is also small if any.

Next, an operation of the above embodiment is explained. At first, many wafers Ware held on the wafer boat 31 in a tier-like manner. Then, the wafer boat 31 is loaded into the reaction tube 21, the power is supplied to the heater 22, and atmosphere in the reaction tube 21 is heated to a target temperature. After that, a process gas such as an oxygen gas is supplied into the reaction tube 21, so that silicon films on the wafers W are oxidized to form silicon oxide films. Regarding the power control of the heater 22, detected values of temperature at the outside wall of the reaction tube 21, that can be detected by the thermometers 25, are transmitted to the temperature controller 6. In the temperature controller 6, differences between the target temperature and the detected values are obtained. Then, as described above, an output value (an analogue signal) is outputted as a current of 4–20 mA.

The output value is converted into a 7-bit digital signal by the A/D converter 51. The CPU 55 uses digital values of the digital signal as the addresses in order to read out data of ON or OFF for the respective switches 45 (45*a*–45*e*) for the 8 cycles (the unit of control) from the pattern table (see FIG. 4) stored in the pattern memory 53. For example, if the output value is output 20%, the read out data may correspond to a content wherein the switch 45*c* is ON for the first and second cycles and the switch 45*d* is ON for the other cycles. The read out data are temporarily stored in the RAM 57 as a buffer memory. On the other hand, the zero-cross detector 52 detects zero degree of phase of voltage, for example based on the voltage waveform at the secondary side of the power transformer 41. Thus, every when a detected signal is outputted from the zero-cross detector 52, process of the CPU 55 is interrupted. Then, code signals of the switches 45 that should be turned or remain ON for the respective cycles from the first cycle by the read out data stored in the RAM 57 are transmitted to the gate driver 54. The gate driver 54 outputs gate signals to the corresponding respective switches 45 (45*a*–45*e*) based on the code signals. Thus, the switches 45 are tuned or remain ON or OFF according to the switching patterns for the switches 45 defined by the pattern table. Thus, the power corresponding to the output value is supplied to the heater 22.

Figure 5:
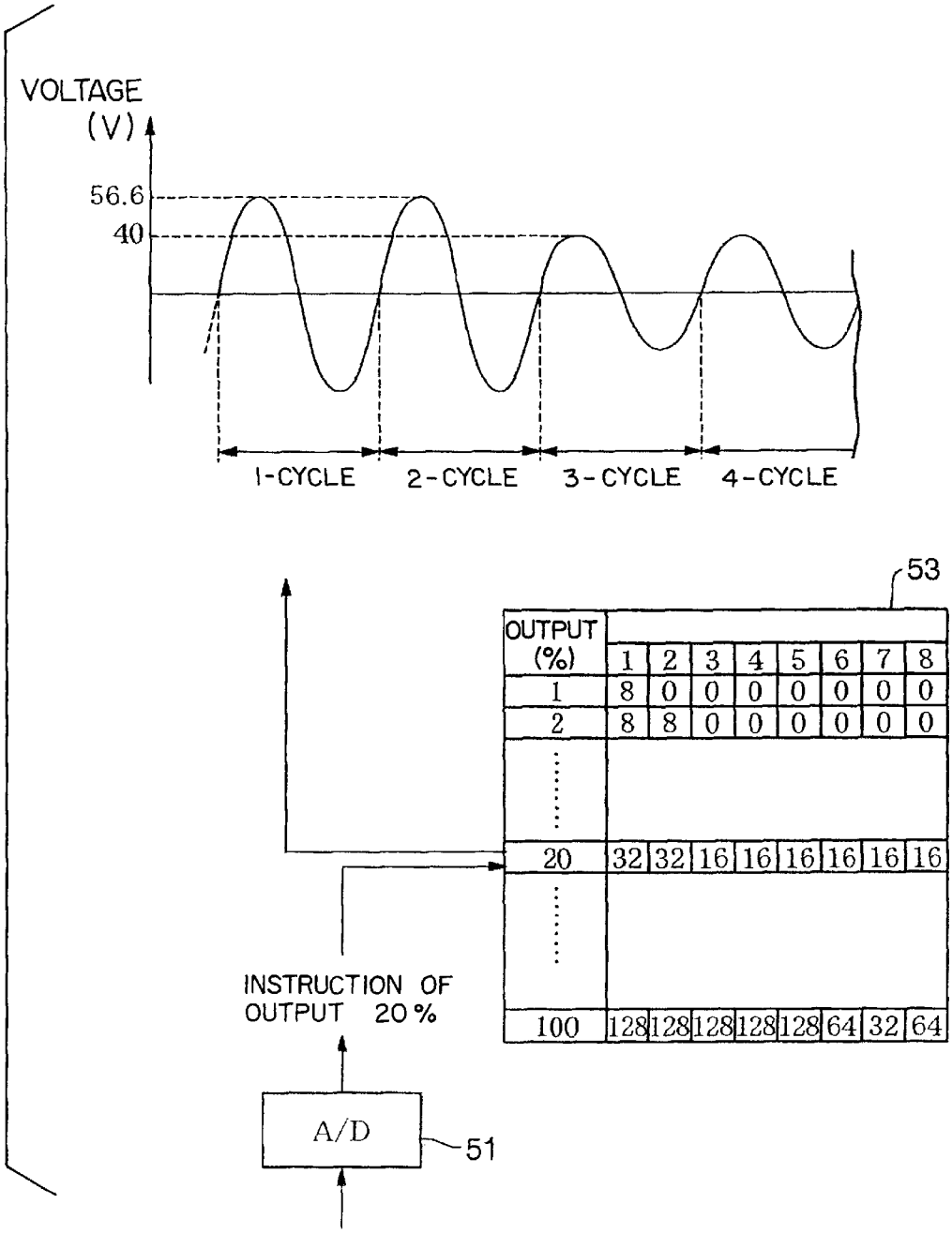
FIG. 5 is a graph of an example of voltage waveform corresponding to a switching pattern.

FIG. 5 is a schematic view of an example of voltage waveform corresponding to read out data.

After the data process for the 8 cycles is completed, for example after the completion, the next switching pattern is read out from the pattern table for the next 8 cycles, based on the output value outputted from the temperature controller 6. Then, similarly to the above, when the detected signal from the zero-cross detector 52 interrupts the process of the CPU 55, the switches 45 can be turned ON or OFF.

According to the above embodiment, since the power transformer 41 is provided with the plurality of voltage taps 42, the power control is conducted based on the switching pattern for the unit of control consisting of several cycles, and the switching pattern is formed as an arrangement of the voltage taps 42 that should be used for the respective cycles, the resolution of the power control can be increased by freely combining the number of the voltage taps and the number of cycles included in one switching pattern.

In general, the heater 22 has a large thermal capacity. Thus, even if the power supply to the heater 22 is turned ON or OFF by the zero-cross controls every several seconds, temperature in the furnace may change only within a small level that may not cause any problem. For example, in the above embodiment wherein the unit of control is 8 cycles, since the 8 cycles of 50 Hz correspond to only 0.16 second, there is no problem in performance of the control.

As described above, according to the embodiment, the power supply to the heater can be controlled very finely. Thus, the atmosphere in the reaction tube 21 can be quickly stabilized to the target temperature. In addition, the temperature of the atmosphere may be made very stable, that is, more evenly heated atmosphere can be obtained. Furthermore, since the resolution of the power control is higher, even if the heater has a great changing rate of resistance against temperature like a heater used for the rapid-heating furnace, the temperature of the heater can be controlled stably.

In addition, in the embodiment, the voltage taps 42 are switched when the voltage crosses zero volt (zero-cross). This can prevent generation of large higher harmonic waves that may be caused in the phase control. In addition, in each switching pattern for the 8 cycles corresponding to each output value stored in the pattern memory 53, the order of the switches 45 turned ON is set in such a manner that voltage difference between two voltage taps for any adjacent two cycles is as small as possible. Thus, higher harmonic waves, which may be generated because of a great voltage difference, can be more effectively prevented from being generated.

In addition, in the embodiment, the respective voltage taps 42 provided in the power transformer 41 are set in such a manner that respective load powers that are generated when the respective voltage taps are selected in turn reduce by half from a maximum thereof to a minimum thereof in order of 1, ½, 1/4, 1/8, and so on. Thus, the power control may be more easily achieved by using binary numbers used in the logic circuit.

As described above, according to the embodiment, the resolution of the power control is enough high, even if the number of the voltage taps is small. However, in order to raise the resolution more, the number of the voltage taps can be increased. Alternatively, the number of cycles included in one switching pattern (the number of cycles for the unit of control) can be increased. For example, although the unit of control in the above embodiment is 8 cycles, the unit of control may be several decade cycles if the heater has a larger thermal capacity. Even in the case of the several decade cycles, performance of the control may be enough good. As described above, based on the object whose power is to be controlled, the resolution can be raised freely.

Figure 6:
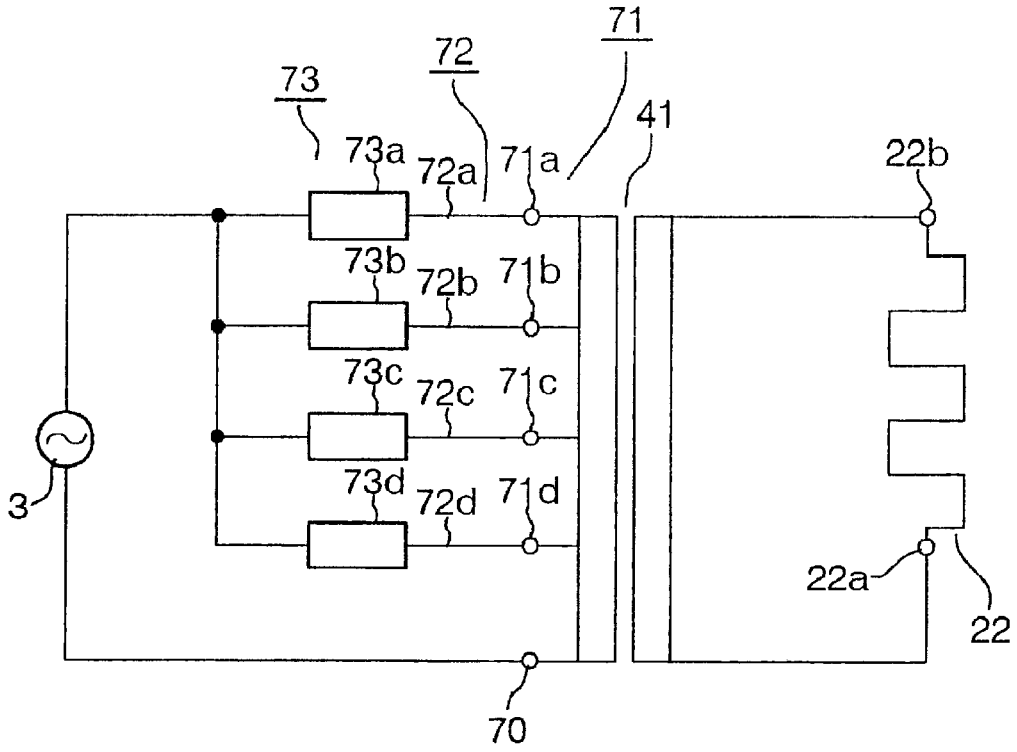
FIG. 6 is a schematic view of another embodiment of a power controlling part.

In the above embodiment, the voltage taps 42 are provided at the secondary side of the power transformer 41. However, as shown in FIG. 6, the voltage taps 71 (71*a*–71*d*) may be provided at the primary side of the power transformer 41. In the case, a terminal 70 at an end of the power transformer 41 is connected to an end of the Alternating-Current power supply source 3. The respective voltage taps 71 (71*a*–71*e*) are connected to the other end of the Alternating-Current power supply source 3 via respective wires 72 (72*a*–72*d*) and a switching part 73 (including switches 73*a*–73*d*).

In the embodiment, voltages based on positions of the voltage taps 71 (71*a*–71*d*) selected by the switching part 73 (respective switches 73*a*–73*d*) are outputted from the secondary side. Thus, in a constant-power control, the respective voltages outputted when the respective voltage taps 71*a*–71*d* maybe selected are set in such a manner that respective load powers reduce by half in order of 100%, 50%, 25% and 12.5%. Thus, the constant-power control may be easily achieved by using binary numbers. In the case too, of course, the number of the voltage taps 71 is free.

Figure 7:
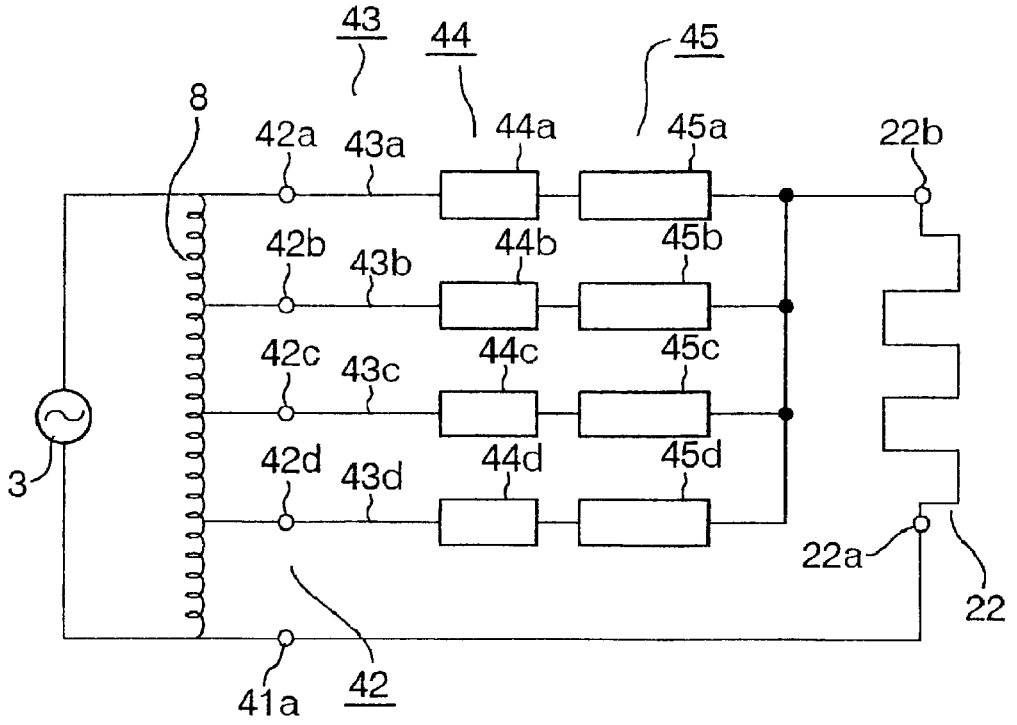
FIG. 7 is a schematic view of another embodiment of a power controlling part.
Figure 8:
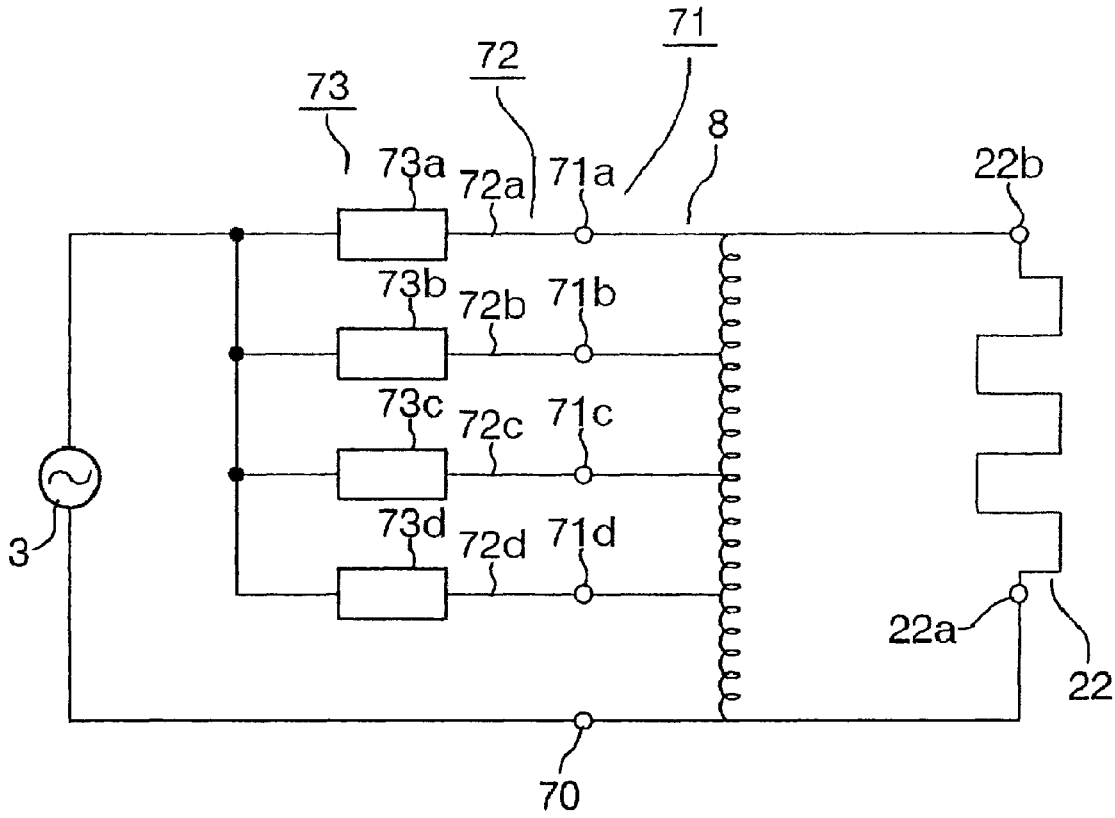
FIG. 8 is a schematic view of another embodiment of a power controlling part.
Figure 9:
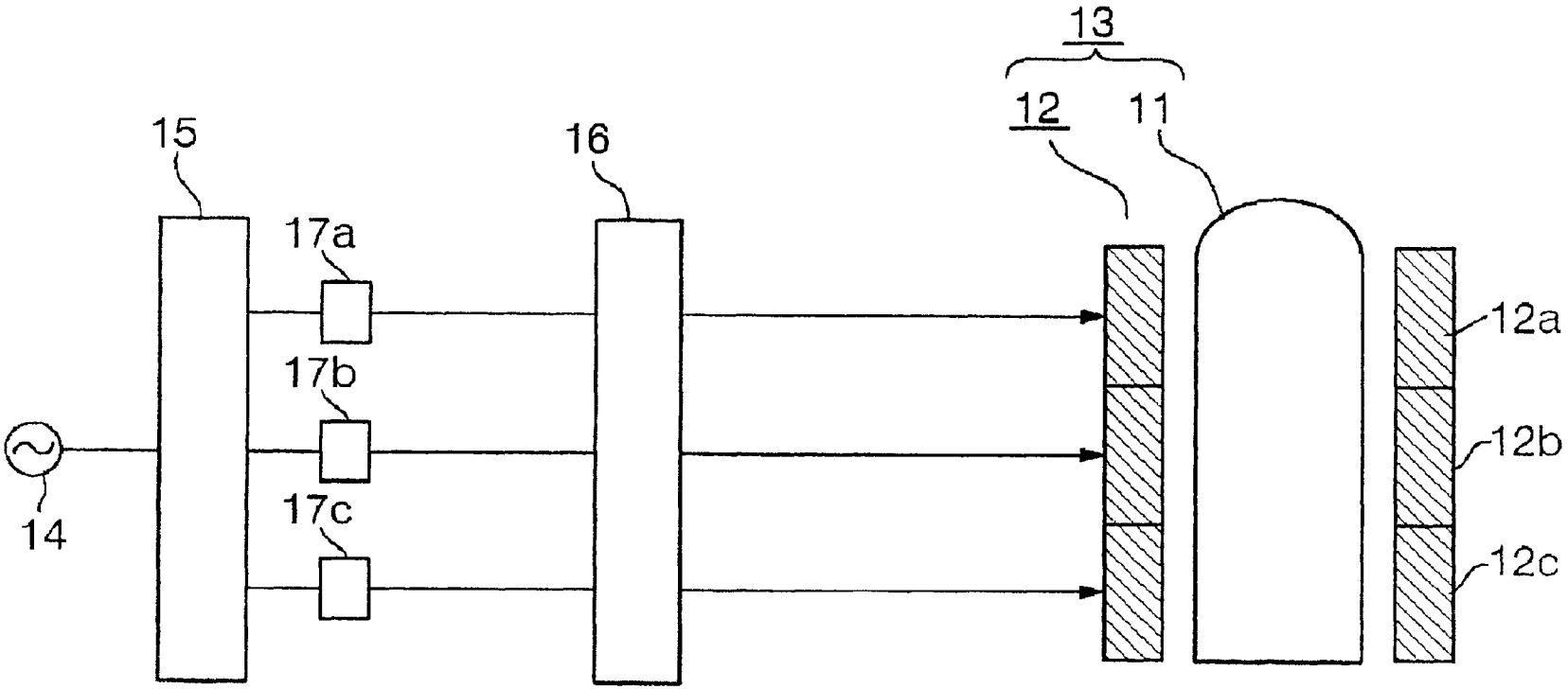
FIG. 9 is a schematic view of a conventional power controlling unit.

The power transformer in the invention is not limited to the transformer 41 having a primary coil and a secondary coil that are insulated from each other. For example, an auto transformer can be used, in which a primary coil and a secondary coil are common, that is, which has only one coil that can be connected to both a power supply source and a load. FIGS. 7 and 8 show such embodiments. In the embodiment shown in FIG. 7, voltage taps 42 (42*a*–42*d*) are provided at a secondary side of the auto-transformer 8. In the embodiment shown in FIG. 8, voltage taps 71 (71*a*–71*d*) are provided at a primary side of the auto-transformer 8.

The timings of turning ON or OFF the switches 45, 73 are not limited to strict zero-cross timings. However, if the timings are deviated form the strict zero-cross timings, volume of the deviation has to be in such a level that higher harmonic waves generated when the switches 45, 73 are turned ON or OFF may not affect the object whose power is to be controlled.

The object whose power is to be controlled is not limited to the heater 22. For example, the object may be a unit that converts electric power into force, such as a motor. Alternatively, the object may be a unit that converts electric power into light, such as a lamp.

The respective voltage taps 42 provided in the power transformer 41 may be set in such a manner that respective load currents or respective load voltages that are generated when the respective voltage taps are selected in turn reduce by half from a maximum thereof to a minimum thereof in order of 1, ½, 1/4, 1/8, and so on. In the case,the output value from the temperature controller 6 may be a current-output value or a voltage-output value, and a rate (%) with respect to the maximum current or the maximum voltage may be defined in the pattern table. In the case too, similarly to the above embodiment, the control may be more easily achieved by using binary numbers used in the logic circuit.

As described above, according to a power controlling unit of the invention, higher harmonic waves can be prevented from being generated and higher resolution can be achieved. In addition, according to a thermal processing unit of the invention, temperature of an atmosphere for processing can be controlled stably in order to conduct a stable thermal process.

What is claimed is:

1. A power controlling unit comprising;

a power transformer having a primary side that can be connected to an Alternating-Current power supply source, and a secondary side having an end side provided with a terminal that can be connected to an end of an object whose power is to be controlled, and the other end side provided with a plurality of voltage taps, a switching part disposed between the plurality of voltage taps and the other end of the object, the switching part selecting one from the plurality of voltage taps in order to connect the one to the other end of the object, a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value, and a switching controlling part that can read a switching pattern corresponding to an output value from the storing part and that can control the switching part based on the switching pattern.

2. A power controlling unit according to claim 1, wherein:

respective load powers that are generated when the respective voltage taps of the power transformer are selected in turn reduce by half from a maximum thereof to a minimum thereof in turn.

3. A power controlling unit according to claim 1, wherein:

respective load currents that are generated when the respective voltage taps of the power transformer are selected in turn reduce by half from a maximum thereof to a minimum thereof in turn.

4. A power controlling unit according to claim 1, wherein:

respective load voltages that are generated when the respective voltage taps of the power transformer are selected in turn reduce by half from a maximum thereof to a minimum thereof in turn.

5. A power controlling unit according to claim 1, wherein:

the switching controlling part can control the switching part to switch the voltage taps when a voltage waveform at the secondary side of the power transformer crosses zero volt.

6. A power controlling unit according to claim 1, wherein:

the object whose power is to be controlled is a heater consisting of a resistance heating element.

7. A power controlling unit comprising;

a power transformer having a secondary side that can be connected to an object whose power is to be controlled, and a primary side having an end side provided with a terminal that can be connected to an end of an Alternating-Current power supply source, and the other end side provided with a plurality of voltage taps, a switching part disposed between the plurality of voltage taps and the other end of the Alternating-Current power supply source, the switching part selecting one from the plurality of voltage taps in order to connect the one to the other end of the Alternating-Current power supply source, a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value, and a switching controlling part that can read a switching pattern corresponding to an output value from the storing part and that can control the switching part based on the switching pattern.

8. A power controlling unit according to claim 7, wherein:

respective load powers that are generated when the respective voltage taps of the power transformer are selected in turn reduce by half from a maximum thereof to a minimum thereof in turn.

9. A power controlling unit according to claim 7, wherein:

respective load currents that are generated when the respective voltage taps of the power transformer are selected in turn reduce by half from a maximum thereof to a minimum thereof in turn.

10. A power controlling unit according to claim 7, wherein:

respective load voltages that are generated when the respective voltage taps of the power transformer are selected in turn reduce by half from a maximum thereof to a minimum thereof in turn.

11. A power controlling unit according to claim 7, wherein:

the switching controlling part can control the switching part to switch the voltage taps when a voltage waveform at the secondary side of the power transformer crosses zero volt.

12. A power controlling unit according to claim 7, wherein:

the object whose power is to be controlled is a heater consisting of a resistance heating element.

13. A method of controlling a power supplied to an object whose power is to be controlled, by using a power controlling unit including;

a power transformer having a primary side that can be connected to an Alternating-Current power supply source, and a secondary side having an end side provided with a terminal that can be connected to an end of the object, and the other end side provided with a plurality of voltage taps, a switching part disposed between the plurality of voltage taps and the other end of the object, the switching part selecting one from the plurality of voltage taps in order to connect the one to the other end of the object, a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value, and a switching controlling part that can read a switching pattern corresponding to an output value from the storing part and that can control the switching part based on the switching pattern, the method comprising:

a setting step of generating an output value to the object correspondingly to the unit of control consisting of the plurality of cycles of the frequency of the Alternating-Current power supply source, a reading step of reading a corresponding switching pattern from the storing part based on the generated output value, and a switching step of changing the voltage taps to be connected to the other end of the object, based on the read switching pattern.

14. A method according to claim 13, wherein:

the switching step is conducted when a voltage waveform at the secondary side of the power transformer crosses zero volt.

15. A method of controlling a power supplied to an object whose power is to be controlled, by using a power controlling unit including;

a power transformer having a secondary side that can be connected to the object, and a primary side having an end side provided with a terminal that can be connected to an end of an Alternating-Current power supply source, and the other end side provided with a plurality of voltage taps, a switching part disposed between the plurality of voltage taps and the other end of the Alternating-Current power supply source, the switching part selecting one from the plurality of voltage taps in order to connect the one to the other end of the Alternating-Current power supply source, a storing part that stores a plurality of output values for the object and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value, and a switching controlling part that can read a switching pattern corresponding to an output value from the storing part and that can control the switching part based on the switching pattern, the method comprising:

a setting step of generating an output value to the object correspondingly to the unit of control consisting of the plurality of cycles of the frequency of the Alternating-Current power supply source, a reading step of reading a corresponding switching pattern from the storing part based on the generated output value, and a switching step of changing the voltage taps to be connected to the other end of the object, based on the read switching pattern.

16. A method according to claim 15, wherein:

the switching step is conducted when a voltage waveform at the secondary side of the power transformer crosses zero volt.

17. A thermal processing unit comprising;

a reacting container that can conduct a thermal process to an object to be processed, a heater arranged surrounding the reacting container, a power transformer having a primary side that can be connected to an Alternating-Current power supply source, and a secondary side having an end side provided with a terminal connected to an end of the heater, and the other end side provided with a plurality of voltage taps, a switching part disposed between the plurality of voltage taps and the other end of the heater, the switching part selecting one from the plurality of voltage taps in order to connect the one to the other end of the heater, a storing part that stores a plurality of output values for the heater and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value, and a switching controlling part that can read a switching pattern corresponding to an output value from the storing part and that can control the switching part based on the switching pattern.

18. A thermal processing unit according to claim 17, wherein:

respective load powers that are generated when the respective voltage taps of the power transformer are selected in turn reduce by half from a maximum thereof to a minimum thereof in turn.

19. A thermal processing unit according to claim 17, wherein:

respective load currents that are generated when the respective voltage taps of the power transformer are selected in turn reduce by half from a maximum thereof to a minimum thereof in turn.

20. A thermal processing unit according to claim 17, wherein:

respective load voltages that are generated when the respective voltage taps of the power transformer are selected in turn reduce by half from a maximum thereof to a minimum thereof in turn.

21. A thermal processing unit according to claim 17, wherein:

the switching controlling part can control the switching part to switch the voltage taps when a voltage waveform at the secondary side of the power transformer crosses zero volt.

22. A thermal processing unit comprising;

a reacting container that can conduct a thermal process to an object to be processed, a heater arranged surrounding the reacting container, a power transformer having a secondary side connected to the heater, and a primary side having an end side provided with a terminal that can be connected to an end of an Alternating-Current power supply source, and the other end side provided with a plurality of voltage taps, a switching part disposed between the plurality of voltage taps and the other end of the Alternating-Current power supply source, the switching part selecting one from the plurality of voltage taps in order to connect the one to the other end of the Alternating-Current power supply source, a storing part that stores a plurality of output values for the heater and a plurality of switching patterns which correspond to the plurality of output values respectively, each of the plurality of output values being set correspondingly to a unit of control consisting of a plurality of cycles of a frequency of the Alternating-Current power supply source, each of the plurality of switching patterns defining a voltage tap that should be selected if any in each of the plurality of cycles in order to achieve the corresponding output value, and a switching controlling part that can read a switching pattern corresponding to an output value from the storing part and that can control the switching part based on the switching pattern.

23. A thermal processing unit according to claim 22, wherein:

respective load powers that are generated when the respective voltage taps of the power transformer are selected in turn reduce by half from a maximum thereof to a minimum thereof in turn.

24. A thermal processing unit according to claim 22, wherein:

respective load currents that are generated when the respective voltage taps of the power transformer are selected in turn reduce by half from a maximum thereof to a minimum thereof in turn.

25. A thermal processing unit according to claim 22, wherein:

respective load voltages that are generated when the respective voltage taps of the power transformer are selected in turn reduce by half from a maximum thereof to a minimum thereof in turn.

26. A thermal processing unit according to claim 22, wherein:

the switching controlling part can control the switching part to switch the voltage taps when a voltage waveform at the secondary side of the power transformer crosses zero volt.

* * * * *